United States Patent [19]

Billmeyer

[11] 4,117,827

[45] Oct. 3, 1978

[54] FIREPLACE CONSTRUCTION

[75] Inventor: Thomas F. Billmeyer, Wisconsin Rapids, Wis.

[73] Assignee: Preway Inc., Wisconsin Rapids, Wis.

[21] Appl. No.: 777,063

[22] Filed: Mar. 14, 1977

[51] Int. Cl.[2] ..... F24B 7/04

[52] U.S. Cl. ..... 126/121; 126/286; 126/288

[58] Field of Search ..... 126/120, 121, 123, 131, 126/286, 288; 237/51

[56] References Cited

U.S. PATENT DOCUMENTS

| | | | |
|---|---|---|---|
| 737,382 | 8/1903 | Frederick | 126/121 |
| 2,093,492 | 9/1937 | Snyder | 126/121 |
| 3,094,980 | 6/1963 | Inabnit | 126/121 |
| 4,026,264 | 5/1977 | Henriques | 126/123 |

*Primary Examiner*—Robert G. Nilson

*Attorney, Agent, or Firm*—Wegner, Stellman, McCord, Wiles & Wood

[57] ABSTRACT

A prebuilt fireplace construction for installation in a building structure. The construction includes a firebox having an open forward side and an outlet for combustion gases and a housing at least partially surrounding the firebox with the combustion gas outlet extending through the top of the housing. A rotatable damper is disposed within the housing and is controlled externally by a rotatable shaft extending forwardly through the housing which is engaged by an external actuator operable from the front of the fireplace. An inlet conduit for combustion air is built into the housing for the fireplace beneath the level of the firebox for supply of combustion air to the firebox in the event doors are later added to close off the firebox.

12 Claims, 5 Drawing Figures

FIREPLACE CONSTRUCTION

BACKGROUND OF THE INVENTION

This invention relates to fireplace constructions and, more particularly, to prebuilt fireplaces adapted to be installed in structures.

The use of prebuilt fireplace constructions is increasing because of the economy and ease of installation in a building structure or a surrounding frame. In such prebuilt fireplaces, it is desirable to provide a complete fireplace structure primarily of sheet metal to minimize the need for additional construction during installation of the fireplace. Conventionally, such preconstructed fireplaces having a built-in damper required reaching into the firebox for positioning thereof. Similarly, a prebuilt fireplace in which impermeable glass doors could later be added did not provide built-in means for controlling the intake of combustion air from the interior of the structure in which the fireplace was installed. When glass doors have been added there has been the necessity to also include a combustion air inlet structure.

SUMMARY OF THE INVENTION

It is the principal object of the invention to provide a prebuilt fireplace construction which may be enclosed by masonry or other structure. More specifically, it is an object of the invention to provide such a structure which has a built-in damper with external control and a built-in combustion air intake and control.

According to the invention, a prebuilt fireplace construction includes a housing having an opening in the forward wall thereof, a firebox positioned within the housing spaced from the walls of the housing and having an opening generally aligned with the housing opening and an outlet for combustion gases extending therefrom through the top wall of the housing, a damper disposed within the outlet and control means for externally controlling the position of the damper within the outlet.

Another object of the invention is to provide a combustion air inlet control assembly built into the housing providing a means for selectively controlling the amount of combustion air drawn into the firebox and which is primarily usable when glass doors are installed to close off the firebox and which avoids the need for a complex frame structure to be added when glass doors are to be used.

In accordance with one feature of the invention, the damper is rotatably supported within the combustion gas outlet and has weight to urge the damper towards an open position. A control shaft rotatably supported within the fireplace mounts the damper and controls the position thereof and has an end portion remote from the damper transverse to the rotational axis of the control shaft. Actuating means including a finger for engaging the transverse shaft portion is movably mounted within the fireplace housing. The actuating means includes a handle extending through a slot defined in the front of housing so that the damper may be selectively positioned by manipulation of the handle at the front of the fireplace. The slot through which the handle extends includes a series of detents along its length which engage the handle to maintain the position of the damper within the combustion gas outlet.

According to another feature of the invention, the combustion air inlet control assembly includes an inlet conduit extending across the lower front of the firebox. An internal passage defined by the conduit communicates with the exterior of the fireplace through passage means in the forward wall of the housing and communicates internally with the firebox through passage means in the upper surface of the conduit. Closure means, such as impermeable elongate members slidably disposed within the conduit, may be moved between completely open and completely closed positions to control the amount of air drawn into the firebox. Operating handles are fixed to the elongate members and extend through slots formed in the forward wall of the housing so that the elongate members may be externally manipulated by the operator. An ashguard is positioned rearwardly of the inlet conduit to prevent combustion material from accumulating within the conduit. Air drawn into the firebox will be delivered past the forward opening in the firebox and past optional glass doors sealing the housing to prevent the accumulation of soot thereon. The combustion air inlet system is built into the fireplace so that if glass doors are added at a later time, this may be done simply without adding a frame including a combustion air inlet structure.

DESCRIPTION OF THE PREFERRED EMBODIMENT

Figure 1:
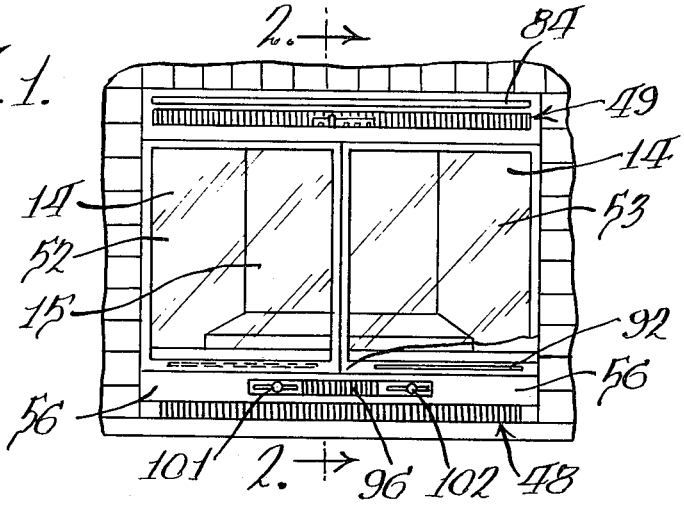
FIG. 1 is a front elevational view of a fireplace construction made in accordance with the invention and shown mounted in a structure.
Figure 2:
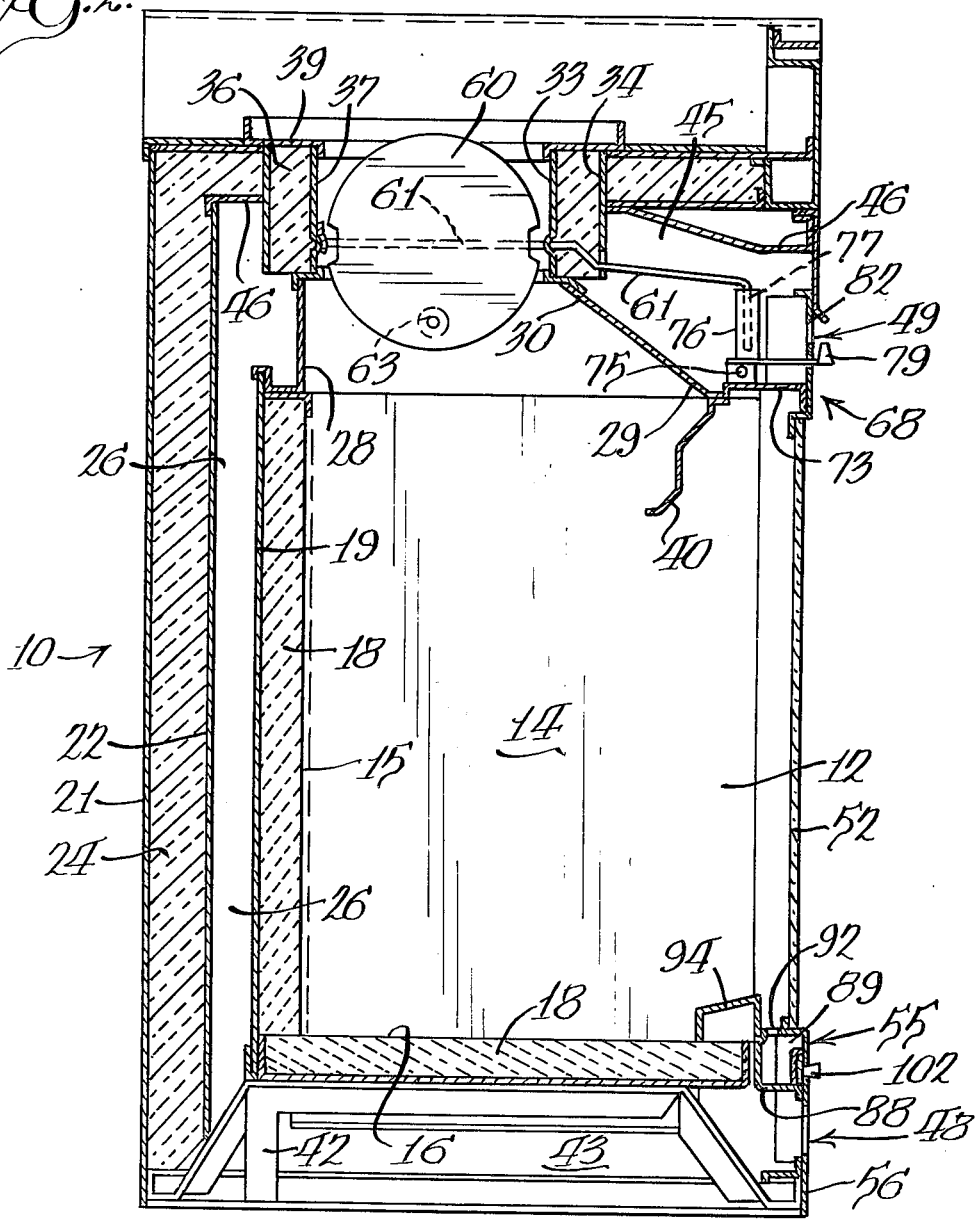
FIG. 2 is an enlarged, vertical cross-sectional view of the fireplace construction taken generally along the line 2—2 of FIG. 1.

With reference to FIGS. 1 and 2, a self-contained fireplace constructed in accordance with the invention is seen to broadly include a housing, generally designated 10, and a firebox 12 within the housing 10 having side walls 14, a rear wall 15 and a floor 16 lined with firebrick 18 and backed by a protective sheet metal wall 19 defining the firebox body. The firebox 12 has a forward opening generally aligned with the forward opening in the housing 10.

The housing 10 has an outer case body including spaced top and bottom walls, spaced side walls and spaced forward and rearward walls partially defined by sheet metal wall 21 and a shield body defined by sheet metal wall 22 with insulating material 24 disposed between the walls 21 and 22. The firebox wall 19 is spaced slightly away from the shield body wall 22 to define a circulating air space 26 between the housing 10 and the firebox 12. Within the housing 10 above the firebox 12 is a hood assembly 28 which narrows progressively from its lower end 29 to its upper end 30. Concentric annular sheet metal walls 33 and 34 having insulation material 36 therebetween define an outlet 37 for combustion gases at the top of the hood assembly 28 which extends through the top wall of the housing 10. A flue (not shown) extending to the exterior of the structure in which the fireplace is installed is fitted over the outlet 37 on a seat 39. A smoke screen 40 depends from the lower forward edge of the hood assembly 28.

The hearth of the fireplace as defined by floor 16 and the firebrick 18 is supported on a base structure 42 so that the firebox 12 is spaced above the lower extremity of the housing 10 and provides a lower continuation 43 of the circulating air space 26. Similarly, an upper continuation 45 of the circulating air space 26 is defined by the tapering hood assembly 28 and the upper wall 46 of the housing 10. A circulating air inlet, such as register 48, is defined at the lower, forward edge of the housing 10. Similarly, a circulating air outlet, such as register 49, is defined at the upper, forward edge of the housing 10. As a result, air may be drawn in through the inlet register 48, circulated by convection around the firebox 12 to absorb heat therefrom, and exhausted through the outlet register 49, while remaining completely isolated from the combustion chamber within the firebox 12.

The open forward side of the firebox 12 is adapted to be optionally sealed by means of two transparent glass doors 52 and 53. The fireplace is provided with hinge structure, not shown, for the optional addition of glass doors. The doors may be added simply since the fireplace has a built-in combustion air inlet control assembly, generally designated 55, defined in the lower forward wall portion 56 of the housing 10 and positioned at the lower forward edge of the firebox.

Within the combustion gas outlet 37 is a disc-like damper 60 fixedly mounted for movement between various open and closed positions on a damper control shaft 61 which, in turn, is rotatably supported by the wall 33. The damper shaft 61 is operated externally from the front of the fireplace by a damper control assembly, generally designated 68, which is disposed within the air space 45 rearwardly adjacent the outlet register 49.

Figure 3:
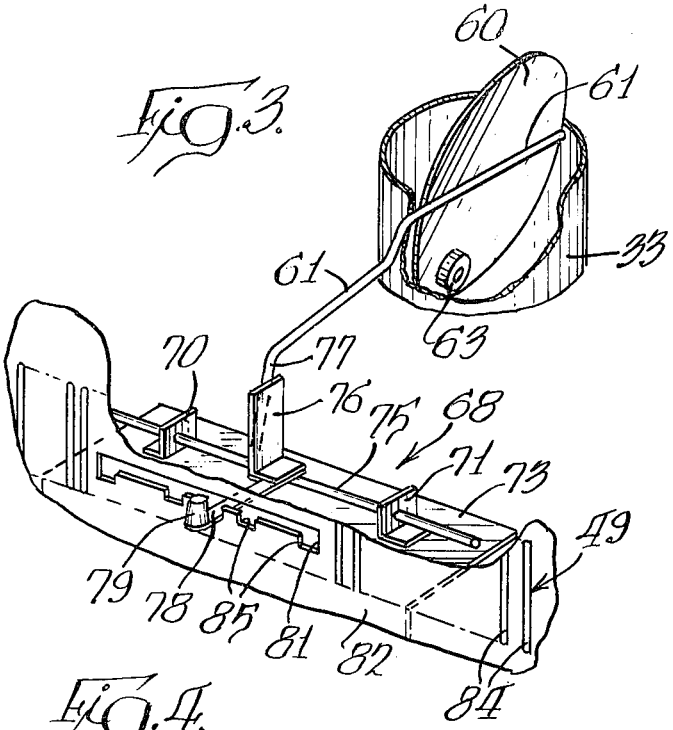
FIG. 3 is a fragmentary perspective view of the damper control assembly in association with a front part of the fireplace construction.
Figure 4:
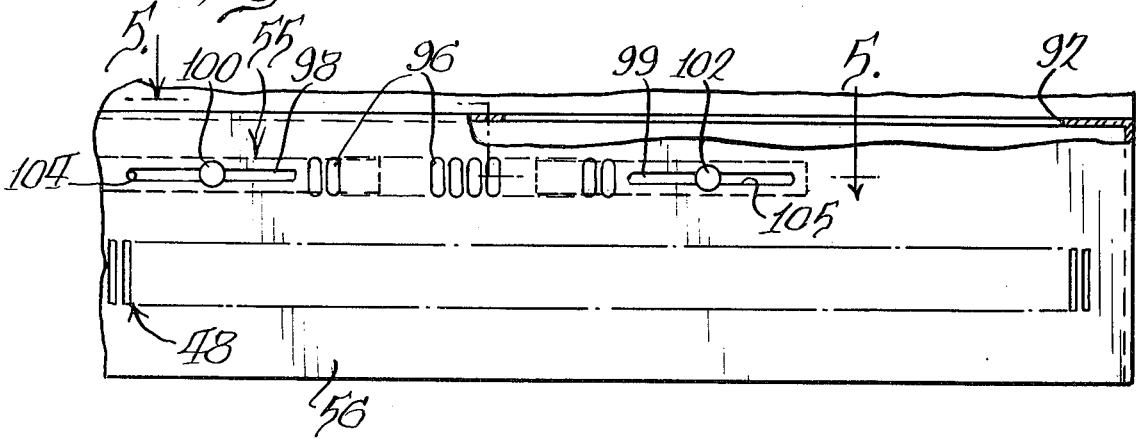
FIG. 4 is an enlarged, fragmentary front elevational view of a lower portion of the fireplace construction illustrating the combustion air inlet control assembly.
Figure 5:
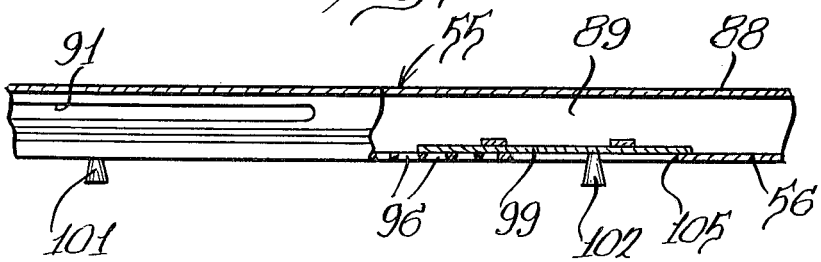
FIG. 5 is a fragmentary horizontal cross-sectional view of the combustion air inlet control assembly taken generally along the line 5—5 of FIG. 4.

As best seen in FIG. 3, the damper control assembly 68 includes a pair of spaced brackets 70 and 71 secured to a horizontal rearwardly extending flange 73 of the housing 10, an elongate rod 75 extending between and slidably supported by the brackets 70 and 71, an upright finger 76 fixed to the rod 75 and extending therefrom to engage a transverse end portion 77 of the damper shaft 61, and a handle 78 fixed to the rod 75 having an external knob 79. The handle 78 extends through an elongate horizontal slot 81 formed in the upper forward wall portion 82 of the housing 10 having the plurality of apertures 84 defining the outlet register 49. The slot 81 has a series of detents or recesses 85 into which the handle 78 may be moved and fixed against lateral movement so as to maintain the damper 60 in selected position.

When the handle 78 is moved leftwardly from the position shown in FIG. 3, the damper shaft 61 is rotated in a clockwise direction so that the damper 60 is rotated toward a fully-closed horizontal position. As a result, the weight 63 is moved to an elevated position and is operative to urge the transverse end portion 77 of the shaft 61 in contact with the left side of the upright finger 76. In contrast, when the handle 78 is moved to the right permitting counterclockwise rotation of the shaft 61, the weight 63 effects counterclockwise rotation of the damper 60 toward a fully-open vertical position and also maintains the transverse end portion 77 against the upright finger 76.

The combustion air inlet control assembly 55 includes a sheet metal structure 88 defining an inlet conduit with an internal passage 89 and elongate apertures 91 and 92 through the top surface of the structure 88 rearward of the glass doors 52 and 53 which open into the combustion chamber of the firebox 12. The placement of the assembly 55 is effective to supply combustion air to the firebox 12 and minimize its space requirements therein. Rearward of the structure 88 at the bottom of the firebox 12 is an ash guard 94 precluding the accumulation of combustion materials within the internal passage 89. A plurality of apertures 96 extend through the center of wall portion 56 of the housing 10 and open to the internal passage 89 to provide passage means for combustion air.

Disposed within the internal passage 89 are elongate, impermeable sheet metal members 98 and 99 which are slidably movable in a horizontal direction by operating knobs 101 and 102, respectively, secured to the respective elongate members 98 and 99 extending through respective elongate slots 104 and 105 in the wall portion 56. The elongate members 98 and 99 can thereby be externally manipulated to open and close the apertures 96 so as to control the amount of air flowing into the firebox 12. Combustion air drawn into the firebox 12 through apertures 91 and 92 flows upwardly past the glass doors 52 and 53 seated on the structure 88 to reduce accumulation of soot and the like thereon.

I claim:

1. In a prebuilt fireplace construction adapted to be installed in a structure, the combination comprising:

a firebox having an open forward side and an outlet for combustion gases;

a housing at least partially surrounding said firebox in close proximity thereto, said outlet extending through the top of said housing;

a damper disposed within said outlet mounted for rotation between open and closed positions;

a shaft rotatably supported within the fireplace to support said damper, said shaft extending through said housing and having one end remote from said damper transverse to the rotational axis of said shaft positioned adjacent a forward wall of said housing;

means movably supported for external actuation of said shaft from the front of the fireplace and having a finger portion for engaging said transverse shaft end and a handle portion external of said housing for operator manipulation of said actuation means whereby movement of said finger portion rotates said shaft to position said damper;

an inlet conduit extending along the forward portion of said housing between the foreward wall of said housing and the forward bottom edge of said firebox, said inlet conduit defining an internal passage communicating externally of said housing through first passage means in the lower part of the forward wall thereof and through second passage means in the upper wall thereof with said firebox, combustion air thereby being drawn in through said first passage means and delivered through said second passage means upwardly into said firebox; and closure means adjacent said first passageway slidably disposed within said conduit for opening and closing said first passage means thereby controlling the amount of air drawn into said firebox.

2. In a prebuilt fireplace construction adapted to be installed in a structure, the combination comprising:

a firebox having an open forward side and an outlet for combustion gases;

a housing at least partially surrounding said firebox in close proximity thereto, said outlet extending through the top of said housing;

a damper disposed within said outlet mounted for rotation between open and closed positions;

a shaft rotatably supported within the fireplace to support said damper, said shaft extending through said housing and having one end remote from said damper transverse to the rotational axis of said shaft positioned adjacent a forward wall of said housing; and means movably supported for external actuation of said shaft having a finger portion for engaging said transverse shaft end and a handle portion external of said housing for operator manipulation of said actuation means whereby movement of said finger portion rotates said shaft to position said damper.

3. The fireplace construction of claim 2 wherein said actuation means includes an elongate member slidably carried within said housing, said finger carried by said elongate member and extending therefrom, and a handle carried by said elongate member extending through an elongate slot in the forward wall of said housing, whereby movement of said handle along said slot effects corresponding movement of said finger and rotation of said shaft and damper.

4. The fireplace construction of claim 3 wherein said elongate slot has a series of detents along its length adapted to engage said handle to maintain the position thereof in said elongate slot.

5. The fireplace construction of claim 3 wherein said shaft has a generally horizontal rotational axis and said transverse end portion generally lies in a vertical plane, said elongate member slidable within a generally horizontal plane with said finger extending vertically therefrom to engage said transverse end portion.

6. The fireplace construction of claim 2 wherein said damper has a weight positioned adjacent one end thereof to urge said one end downwardly and effect rotation of said shaft, said transverse end of said shaft thereby being urged into engaging contact with the finger portion of said actuation means, said finger portion limiting rotation of said shaft and controlling the position of said damper.

7. In a prebuilt fireplace construction adapted to be installed in a structure, the combination comprising:

a firebox having an open forward side and an outlet for combustion gases;

a housing at least partially surrounding said firebox in close proximity thereto, said outlet extending through the top of said housing;

an inlet conduit extending along the forward portion of said housing between a forward wall of said housing and the forward bottom edge of said firebox, said inlet conduit defining an internal passage communicating externally of said housing through first passage means in the lower part of the forward wall thereof and through second passage means in the upper wall thereof with said firebox, combustion air thereby being drawn in through said first passage means and delivered through said second passage means upwardly into said firebox; and closure means adjacent said first passageway slidably disposed within said conduit for opening and closing said first passage means thereby controlling the amount of air drawn into said firebox.

8. The fireplace construction of claim 7 wherein said closure means includes a pair of elongate generally flat members bearing against the forward wall and having operating handles extending externally through elongate slots defined in the forward wall of said housing so that the position of said flat members relative to said first passage means may be externally manipulated by an operator.

9. The fireplace construction of claim 7 wherein said first passage means is a series of apertures in the forward wall of said housing intermediate the side walls said closure means includes impermeable elongate members bearing against the forward wall and movable to completely close said apertures.

10. The fireplace construction of claim 7 wherein said upper wall of said conduit is generally level with the bottom of said firebox, and further including an ash guard in said firebox rearward of said second passage means to preclude accumulation of combustion material within said conduit.

11. The fireplace construction of claim 10 further including movable doors forward of said second passage means tc selectively open and close the forward opening of said housing, the upward flow of combustion air from said second passage means preventing accumulation of combustion material on the interior of said doors.

12. In a prebuilt fireplace construction adapted to be installed in a structure, the combination comprising: a firebox having an open forward side and an outlet for combustion gases; a housing at least partially surrounding said firebox in close proximity thereto, said outlet extending through the top of said housing; a damper disposed within said outlet movable to plural positions including open and closed positions; and a shaft rotatably supported within the fireplace and having said damper fixed thereto for rotation therewith, said shaft extending from said damper forwardly through said housing between said firebox and housing and having one end remote from said damper positioned outside of the firebox generally at the level of said damper and above and adjacent the open forward side of the firebox, rotation of the one end of said shaft about the rotational axis of the shaft rotating the damper so that the damper may be rotated between open and closed positions, and manually operable means associated with said shaft and positioned above the open forward side of the firebox for positioning said damper in a selected one of said positions manually without reaching into the firebox.

* * * * *